United States Patent [19]

Kapadia et al.

[11] 4,278,900

[45] Jul. 14, 1981

[54] FAIL-SAFE PULSE PROVIDING APPARATUS

[75] Inventors: Jayant K. Kapadia, Pleasant Hills; Thomas C. Matty, North Huntingdon, both of Pa.

[73] Assignee: Westinghouse Electric Corp., Pittsburgh, Pa.

[21] Appl. No.: 12,546

[22] Filed: Feb. 15, 1979

[51] Int. Cl.[3] ..... H03K 3/42; H03K 5/19

[52] U.S. Cl. ..... 307/311; 307/246; 328/120; 246/29 R

[58] Field of Search ..... 307/311, 246; 328/120, 328/2; 340/507; 318/563; 246/29, 34 R; 250/211

[56] References Cited

U.S. PATENT DOCUMENTS

| | | | |
|---|---|---|---|
| 3,036,225 | 5/1962 | Kladde | 307/301 |
| 3,551,889 | 12/1970 | Miller | 340/171 |
| 3,562,712 | 2/1971 | Thorne-Booth et al. | 340/168 |
| 3,582,892 | 6/1971 | Hoyler | 340/168 |
| 3,586,982 | 6/1971 | Hoyler | 328/48 |
| 3,588,709 | 6/1971 | Hoyler | 328/63 |
| 3,593,022 | 7/1971 | Hoyler | 340/163 |
| 3,691,368 | 9/1972 | Hoyler | 246/29 R |
| 3,743,858 | 7/1973 | Woods | 307/218 |
| 3,867,684 | 2/1975 | Ginsberg et al. | 307/246 |
| 3,995,173 | 11/1976 | Sibley | 307/311 |
| 4,099,157 | 7/1978 | Enabnit | 340/507 |

FOREIGN PATENT DOCUMENTS

| | | |
|---|---|---|
| 1478416 | 6/1977 | United Kingdom . |
| 1484353 | 9/1977 | United Kingdom . |
| 1335680 | 10/1977 | United Kingdom . |

OTHER PUBLICATIONS

The BARTD Train Control System by W. P. Bollinger, Westinghouse Electric Corp., Reprint from Railway Signaling & Communications, 12/67, 6 pgs.

*Primary Examiner*—Stanley D. Miller, Jr.
*Assistant Examiner*—B. P. Davis
*Attorney, Agent, or Firm*—R. G. Brodahl

[57] ABSTRACT

There is disclosed improved time slot scanner control apparatus, including a fail-safe control pulse former apparatus provided for each of a desired plurality of information time slots to sequence the data information transfer in relation to the respective track circuits operative with a transit vehicle. An information timing track is provided for sequencing this data information transfer and to reset the apparatus after each provided sequence of time slot control pulses.

6 Claims, 7 Drawing Figures

FAIL-SAFE PULSE PROVIDING APPARATUS

BACKGROUND OF THE INVENTION

It is known in the prior art to provide speed command information for controlling a transit vehicle by multiplex coding as described in an article entitled "The BARTD Train Control System" that was published in Railway Signaling & Communications for December 1967 at pages 18 to 23. The extraction of this coded speed command information is by a well-known timing track signal including a word pulse followed by a plurality of time slot pulses, with the word pulse comprising a space used for synchronization purposes so the proper time slot and corresponding track circuit can be selected for the respective information bits of the speed command data. The data down information including the multiplex speed code is provided to all the transmitter receivers operative with the transit vehicle. Each transmitter and receiver is assigned a particular track circuit and a specified time slot. The time slot scanner is provided to pick up data for a particular time slot and enable the corresponding transmitter to be operative with that assigned time slot data. The word pulses synchronize the operation such that the desired data for a given time slot is picked up from the data down information. A six-bit speed code is transmitted in six successive sequences of this word pulse with each word pulse being the beginning of a new sequence such that it would take six word pulse sequences to reconstruct the complete six-bit speed code. The receiver for each track circuit is operative such that the signal coming from the track circuit will be decoded as a six-bit code and the time slot will take off that data one bit at a time and put it on the multiplex data line going back to the station multiplex cabinet as data back. In the station multiplex cabinet, there is a bit-by-bit comparator which compares in a fail-safe manner the data sent to the track circuit with the data coming back from the track circuit to determine if the particular track circuit is occupied or not. In the prior art, each track circuit had its associated wayside time slot scanner for a particular time slot assigned to that track circuit, and in this manner picked off the data from the multiplex line, which data was desired for that particular track circuit, such that it would pick off the speed command information one bit at a time as it appeared on the same time slot in each sequential operation determined by the word pulse associated with the speed code pulses.

SUMMARY OF THE INVENTION

The present invention relates to pulse former apparatus operative with the timing track signal having a pulse gap followed by a plurality of time slot pulses, with each such apparatus being provided for a different time slot for the generation of a fail-safe control pulse for that time slot, and includes sequencing the operation of each respective provided pulse former apparatus in relation to the timing track signal and having a reset apparatus responsive to each word pulse to synchronize each cycle of that operation. In this way, there is generated a series of pulses that can be used to scan a speed code generation signal with the requirement that one and only one of these pulses can exist for each particular time slot and each point in time.

DESCRIPTION OF THE PREFERRED EMBODIMENT

Figure 1:
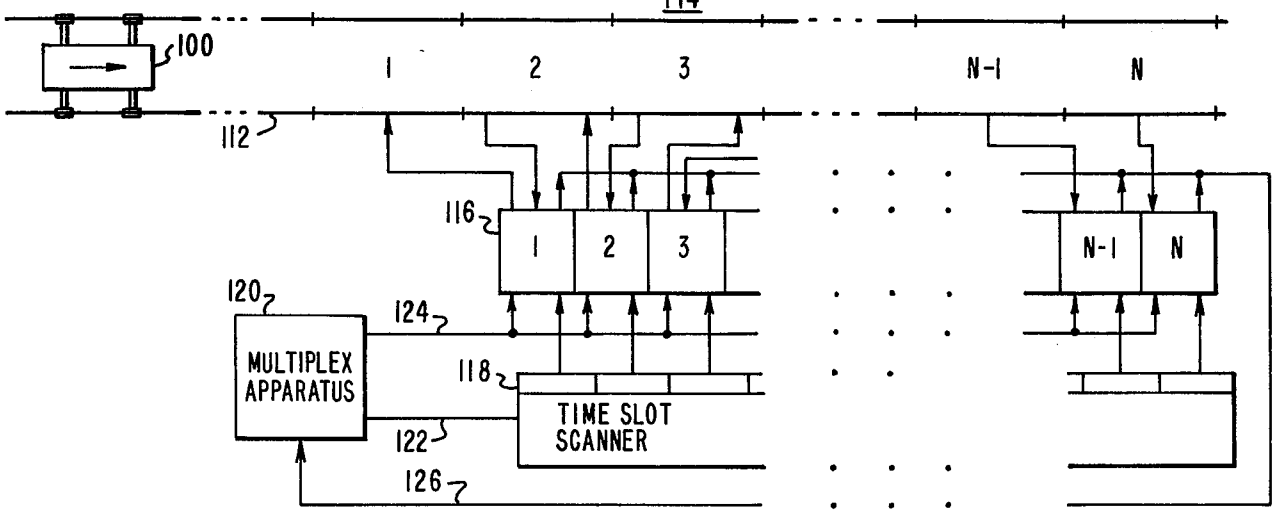
FIG. 1 PRIOR ART
FIG. 1 shows a prior art speed command signal system, including the time slot scanner apparatus for synchronizing each predetermined speed command bit with a particular vehicle track circuit.

In FIG. 1 there is shown a prior art transit vehicle control system including speed commands being communicated to the vehicle in each track circuit of a station, with the same track circuits being used for presence detection. The equipment to determine the vehicle occupancy detection and the track circuit signalling is located in each station, which is associated with a plurality of track circuits. Each track circuit is assigned a particular time slot, such that this time slot enables the speed information for the particular track circuit to be supplied to that track circuit and also enables the vehicle occupancy information from that track circuit to be supplied back to the station equipment. In FIG. 1 the transit vehicle 100 is shown operative with a track 112 including an illustrative station area 114 including a desired plurality of track circuits 1, 2, 3, through N-1 and N. Each of these track circuits includes a transmitter receiver 116 operative with a time slot scanner 118 that is supplied speed command information from a station signal multiplex apparatus 120. The multiplex apparatus 120 supplies a timing track 122 to control the operation of the time slot scanner 118, which timing track 122 includes a like plurality of time slot signals and followed by a word pulse for controlling the operation of the time slot scanner 118. The time slot scanner 118 functions like a shift register, which starts its operation in response to the word pulse and then propagates through a sequence of time slot pulses for determining the data down information 124 in relation to the track circuits 1, 2, 3 through N within the station 114. Each word pulse on the timing track 122 operates with a reset circuit to reset the time slot scanner 118 for starting the next timing sequence in relation to the track circuits associated with that time slot scanner 118. The timing track 122 coming from the station signal multiplex apparatus 120 can be a 576 Hertz timing track with a missing pulse following each desired plurality of time slot control pulses.

Figure 2:
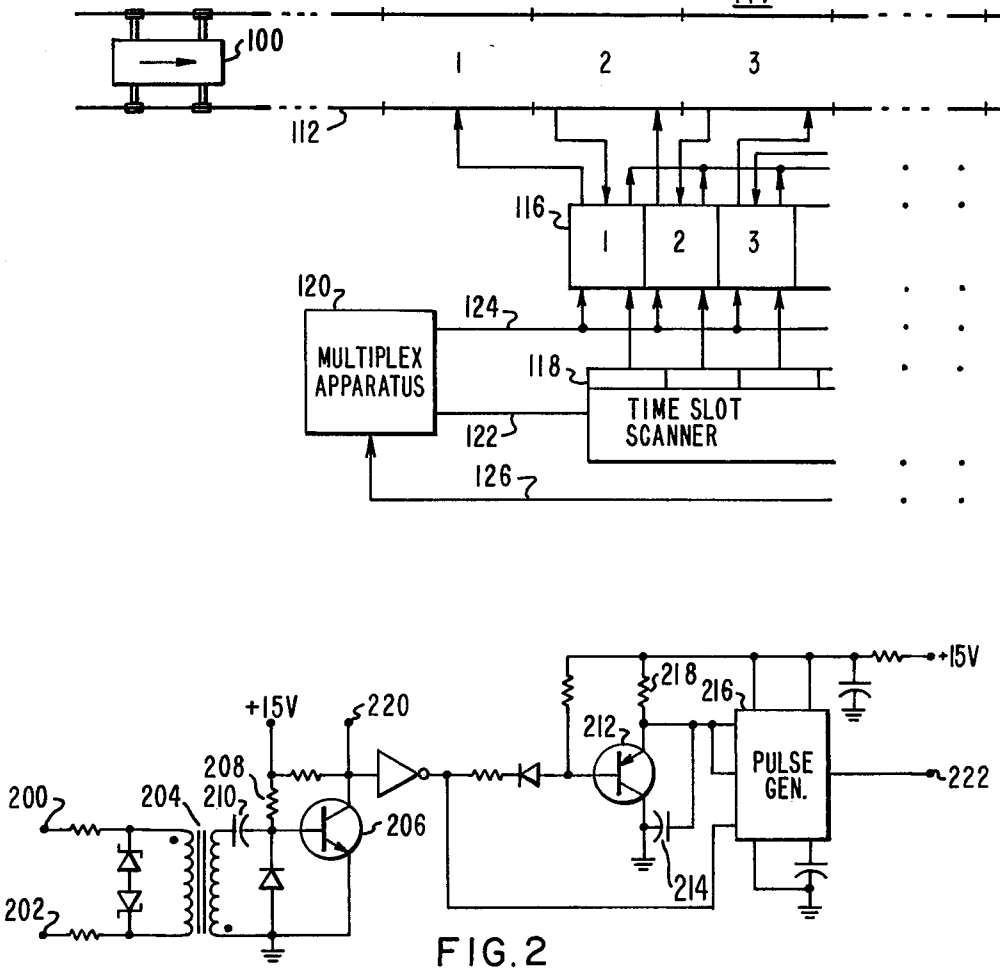
FIG. 2 shows the apparatus provided to generate the desired time slot sequence reset control pulse.

In FIG. 2 there is shown a circuit provided to detect the word pulse and generate a sequence reset control pulse to determine the beginning of a new cycle for the time slot scanner 118. The timing track with the missing pulse is applied to inputs 200 and 202 shown in FIG. 2. Each timing track pulse is differentially coupled through the transformer 204 to provide isolation and in turn causes the normally on transistor 206 to turn off. The timing track looks like 576 squarewaves per second with a pulse missing after each desired plurality of pulses, such as after every 31 pulses. The transistor 206 is biased by the resistor 208 and capacitor 210 timing circuit. When a pulse in the timing track appears at the input, it turns off the transistor 206 at the rate of 576 per second with a gap provided by the missing pulse. With the output from the transistor 206 triggering the transistor 212 so that the capacitor 214 does not get a chance to charge up to the required voltage, such as 7 to 10 volts, and the pulse generator 216, which is a standard and well-known 555 pulse generator, remains high. When the missing pulse appears, the transistor 212 remains off for a longer duration which in turn allows the capacitor 214 to charge up to a higher and required voltage, which in turn triggers the pulse generator 216 and produces a reset control pulse whose duration is determined by the resistor 218 and capacitor 214 time constant circuit. In this way, the reset control pulse is generated to determine the beginning of a new cycle or sequence of time slots.

Figure 3A:
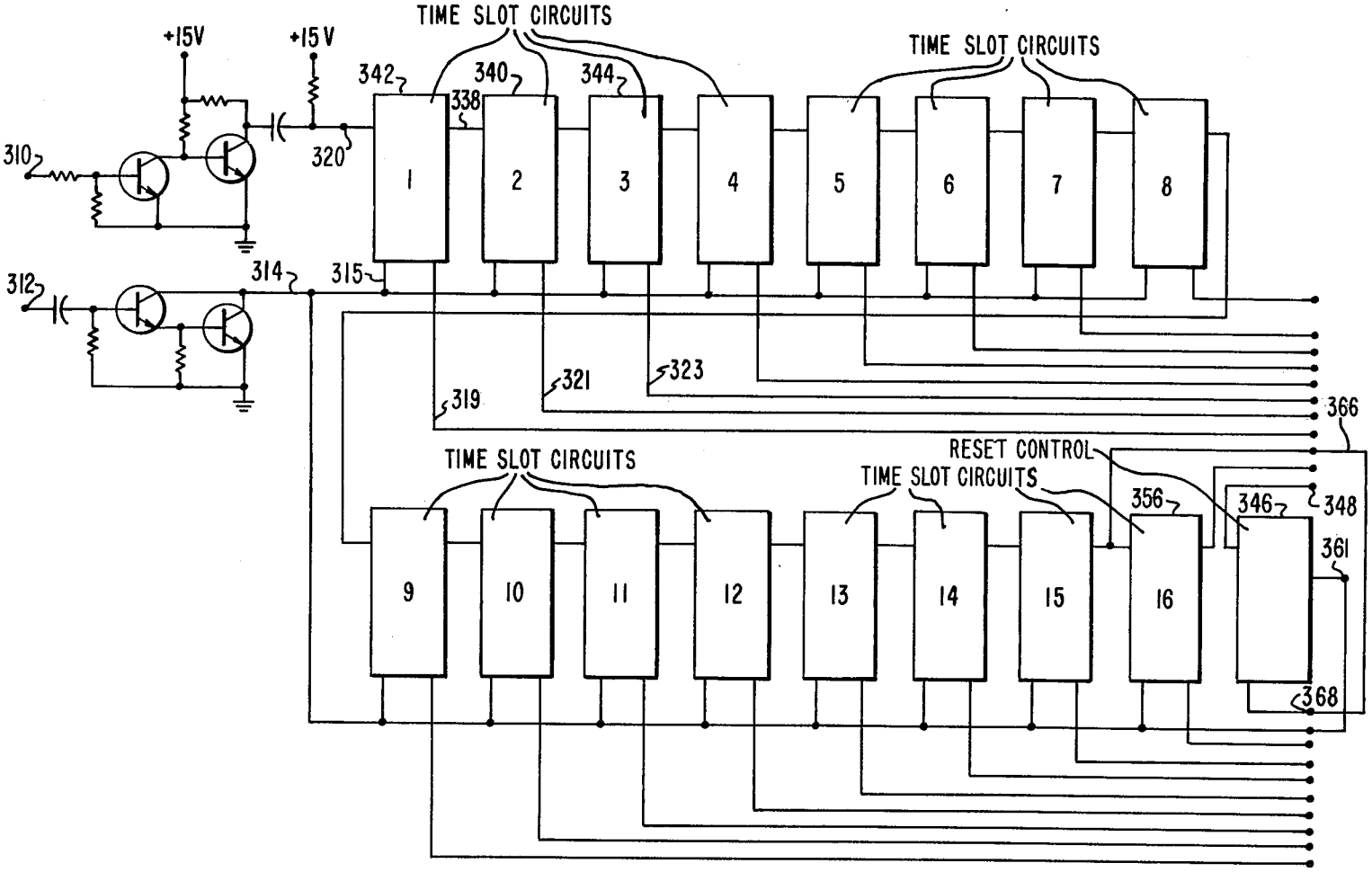
FIGS. 3A, 3B and 3C illustrate the pulse former apparatus of the present invention as provided for each track circuit time slot and the sequencing shift register arrangement, with the word pulse responsive reset apparatus in accordance with the present invention.
Figure 3B:
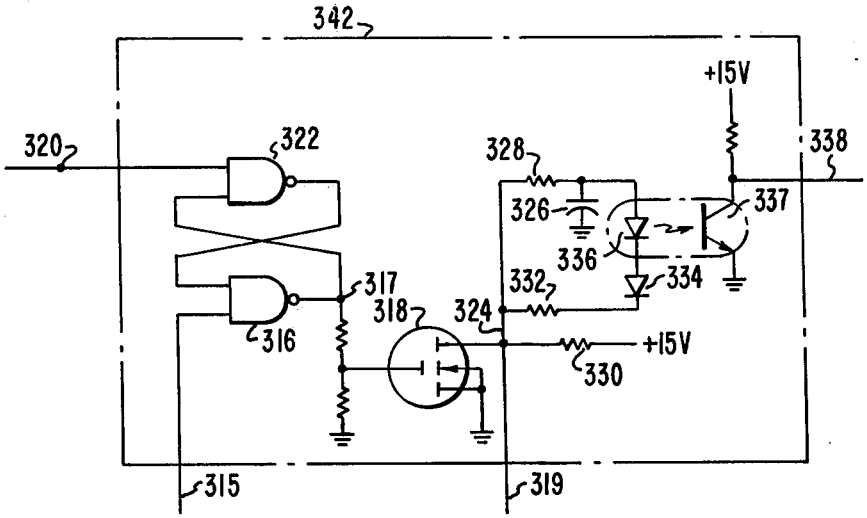

When the time control pulse comes in through input connection 310 shown in FIG. 3A, it sets the lead 317 shown in FIG. 3B to low and turns off the transistor 318 to start charging the capacitor 326 for the purpose of picking off the speed code pulse from the multiplex line and feeding it to the transmitter corresponding to track circuit 1. In effect, a fail-safe time slot scanner is provided in FIG. 3A for generating an array of desired time slot pulses which is operative such that only one pulse at a time can be generated and the pulse position is precisely defined. The time slot scanner is operative to generate a first pulse on output conductor 319 to look at the multiplex line and pick off a particular speed code bit at a point in time corresponding to track circuit 1 and then a second pulse on output conductor 321 to pick off the next successive speed code bit for track circuit 2 and then a third pulse on output conductor 323 to pick off the next successive speed code bit for track circuit 3 and so forth. The time slot scanner generates the successive time slot pulses so that each receiver and transmitter operative with a particular track circuit is controlled successively to look at the multiplex line and pick off the required speed code bit for the respective time slot assigned to that individual track circuit. At the same time, vehicle occupancy data is put back onto the data back line by the receiver operative with each particular track circuit; and for this purpose, the same set of time slot control pulses is used.

As shown in FIG. 3B, when the voltage at lead 324 goes to a high level, the current flows through the resistor 328 into the capacitor 326. There is no current path through the resistor 332 because of the blocking diode 334 and the blocking action of the opto-isolator light emitting diode 336. The purpose of the diode 334 is to permit higher voltages than the opto-isolator could normally permit. When the conductor 324 goes to a high voltage, the capacitor 326 is charged through the RC time circuit including the resistor 328 and the capacitor 326, with the time required to charge that capacitor being determined by the RC time constant of that circuit. If the high voltage pulse on conductor 324 is for a long enough period of time, the capacitor 326 stores up enough energy such that when the voltage on conductor 324 goes low, the energy stored in the capacitor 326 discharges through two paths, with a first path being back through the resistor 328 and the other second path through the forward biased optical isolator diode 336, the diode 334 and the resistor 332. The time constant of the second path through the resistor 332 is chosen to be substantially less than the time constant of the first path through the resistor 328, such that most of the energy will flow through the light emitting diode 336 such that the light emitting diode 336 generates photons to operate with the photo-transistor 337 to generate a negative-going pulse at the output conductor 338. The time slot control circuit 342 is fail-safe in operation in that the only point in time that the output pulse can be provided on conductor 338 is after the pulse on conductor 324 goes low and, in addition, the current flow charging the capacitor 326 is in the opposite direction of the discharge current from the capacitor 326 in relation to the energization of the light emitting diode 336 since the light emitting diode 336 is forward biased from the stored energy on the capacitor 326, and the only way that sufficient stored energy is provided for the capacitor 326 is to have the control pulse on the conductor 324 high for a sufficiently long period of time to overcome the time constant of the resistor 328 and capacitor 326. The fail-safety operation comes from the fact that the control pulse on the conductor 324 is provided for a sufficient period of time to avoid provided noise pulses and the like from undesired charging the capacitor 326 and, in addition, a negative voltage condition on conductor 324 has to be provided to cause the discharge current from the capacitor 326 to flow through the light emitting diode 336.

Figure 4:
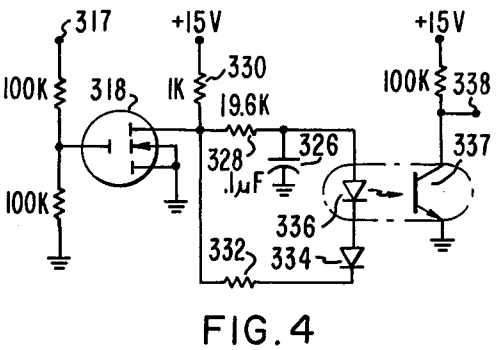
FIG. 4 shows the pulse former apparatus of the present invention with illustrative component values.

In FIG. 4, there is shown one of the fail-safe pulse former circuits that was included in FIG. 3B, and shows the input terminal 317 which goes to a high voltage for each timing track pulse. When the terminal 317 goes low, this turns off the transistor 318 and begins charging the capacitor 326. When the terminal 317 goes high at the end of the timing track pulse, the capacitor 326 discharges through the light emitting diode 336 to provide photons for energizing the transistor 337 to provide an output pulse for a time period determined by the discharge time period of the capacitor 326 and until the voltage drop across the light emitting diode 336 reaches a voltage level in the order of 7 to 10 volts. The components of one actual embodiment that was made of the fail-safe pulse former apparatus shown in FIG. 4 were as follows:

R328=19.6K ohms
C326=0.1 microfarad
R332=51.1 ohms

Figure 3C:
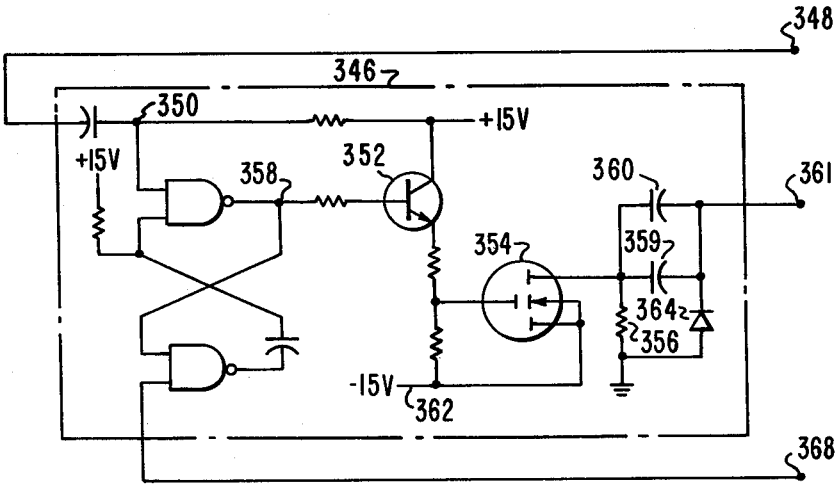

The time slot scanner 18 shown in FIG. 1 can include a desired plurality of track circuit time slot pulse former circuits, such as circuit 342 shown in FIG. 3A. Since the circuit board shown in FIG. 3A is shown to include sixteen such time slot pulse former circuits, if additional circuits are desired it is necessary that two such circuit boards be coupled together to use sixteen time slot pulse former circuits of one board and up to fifteen similar time slot circuits of the other. The reset circuit 346 shown in FIG. 3A and in FIG. 3C is not then used on the first board having sixteen operative time slot circuit stages and the reset circuit 346 on the second board resets all of the time slot pulse former circuits, and then the timing track signal which is applied to both circuit boards will initially operate the first stage circuit 342 in conjunction with a 1/18 second word control pulse on input 310 and then the output of the first pulse former circuit 342 on connection 338 in conjunction with the next timing track signal pulse will operate the second time slot pulse former circuit 340 and the output signal from the second time slot circuit 340 in conjunction with the third timing track pulse operates the third time slot circuit 344 and so forth. In this way the time slot scanner propagates through the successive time slot circuits to provide the desired successive time slot information control in relation to the track circuits operative with the time slot scanner shown in FIG. 3A.

The reset circuit 346 shown in FIG. 3A and FIG. 3C is operative to reset each of the respective time slot circuits of the one or two circuit boards of the time slot scanner, with one such circuit board being shown in FIG. 3A. When the transistor 354 turns on by the output pulse from the provided last time slot circuit of the time slot scanner, the transistor 354 connects the junction of resistor 356 and capacitors 359 and 360 to the terminal 362 having a minus 15 volt potential. The capacitors 359 and 360 charge to minus 15 volts through the diode 364 and the transistor 354, and the next word pulse into terminal 348 turns off the transistor 352. Then the transistor 354 also turns off because its gate is now referenced to the same voltage as its source. When the transistor 354 turns off, suddenly the junction of resistor 356 and capacitors 359 and 360 is connected to ground through the resistor 356. Since the capacitor cannot change its voltage instantaneously, the anode of the diode 364 suddenly sees a plus 15 volt level because the capacitor was originally charged to minus 15 volts and this junction is at ground potential. The plus 15 volts at terminal 361 is then connected to enable shift register conductor 314 and all the input terminals 315 of the respective time slot pulse former circuits and all these shift register circuits are now enabled. If the reset circuit 346 does not function properly, all of the terminals 315 will be set to either zero or slightly negative voltage and the time slot scanner shown in FIG. 3A will not function. The reset circuit 346 has to reset each of the time slot circuits after every sequence cycle or desired plurality of pulses of the timing track, and when the synchronizing word pulse is received, not only does it start the operation at the first pulse former circuit stage 342 but it also resets the whole desired plurality of such circuits plus resets the time slot scanner by turning the transistor 352 of the reset circuit 346 on and off. After the last desired time slot pulse, the output connection 366 is provided to input 368 which in turn generates a pulse to turn the transistor 352 on and allow the capacitor 359 and capacitor 360 to be charged to minus 15 volts by turning the transistor 354 on. In this way, the word pulse starts the sequential operation of the time slot scanner and the respective pulses of the timing track signal propagate the sequential operation of the time slot scanner through each of the desired plurality of successive stages. The next time a word pulse is provided after the last desired time slot pulse, it turns on the transistor 354 and charges the capacitors 359 and 360 to minus 15 volts and starts a new cycle of operation. When the transistor 354 is turned off, the voltage at terminal 361 goes to plus 15 volts and this enables the whole time slot scanner for another desired plurality of successive time slot pulses for the respective track circuits.

For the time slot scanner to function properly, the timing track signal must include a time slot pulse for each track circuit and a missing pulse which causes a word pulse to be generated on the circuit board, the transistor 352 must be turned on after the last time slot pulse and the word pulse must again turn off the transistor 352 for the time slot scanner to function as desired. if any one of these pulses is not provided, the time slot scanner will not so function. Any failure would be detectable in that all of the track circuits in a given station serviced by a particular time slot scanner will show a vehicle occupancy condition.

The station signal multiplex apparatus 120 shown in FIG. 1 functions to take the desired speed code for each track circuit in a given station, generate the required speed codes and put this speed code information into the required relationship with the respective time slots preassigned to the individual track circuits to enable the time slot scanner 118 and the respective transmitter receivers 116 to pick off each desired speed code bit from the data down information 124, which speed code is transmitted to the associated track circuit, and the vehicle 100 will respond to this speed code and determine what speed the vehicle is supposed to be going in that track circuit. The occupancy of that track circuit will be determined by the receiver sensing the speed code information transmitted, so these time slots are required to be fail-safe in the sense that one time slot cannot be made wider and spill over into the next time slot and thereby result in decoding the wrong speed code for any one of the track circuits. In addition the station signal multiplex apparatus 120 includes a bit-by-bit comparator, which is a fail-safe circuit and determines the vehicle occupancy in each of the station track circuits by comparing the transmitted and the received speed codes for a given time slot such that the received speed code is now compared against the transmitted speed code and if they are exactly the same the multiplex apparatus 120 establishes that there is no vehicle occupancy in the associated track circuit, but if they are different in any way the apparatus 120 functions to establish that the track circuit either failed or it is occupied. The time slot scanner 118 establishes the time slot so that the transmitter can pick off the correct speed code to be transmitted to the track circuit and the receiver can pick off the correct data coming from the track circuit and send it back to the station signal multiplex apparatus 120.

Each transmitter and receiver 116 is assigned a given track circuit and a given time slot, which time slot would occur between two word pulses of the timing track signal 122. The operation is synchronized at the station signal multiplex apparatus 120 and the time slot scanner 118 is synchronized by the word pulses so that the correct time slot data is picked up from the multiplex speed code. The six-bit speed code is transmitted in six successive sequences of this word pulse, and each word pulse establishes the beginning of a new sequence or cycle of operation of the time slot scanner 118. It takes six word pulse sequences to reconstruct the complete speed code for a given track circuit. The receiver functions in a similar manner but the information flow is in the opposite direction such that a signal will come in from the track circuit and will be decoded as a six-bit code, and the time slot will take off that data one bit at a time and put it back on the multiplex data back line 126 which goes back to the station signal multiplex apparatus 120. The time slot scanner 118 includes the fail-safe pulse former apparatus shown in FIG. 3A, and the pulse shift register arrangement, which fail-safely generates the time slot control pulses shown in FIG. 5 and fail-safely shifts the pulses with the requirement that a word pulse starts each sequence. Each time slot control pulse has to have a given duration and be not wider than that duration to properly synchronize the respective time slots for the track circuits. After the last time slot control pulse has been provided, the reset circuit 346 shown in FIG. 3A functions to reset the whole sequence of operation, and waits for the next word pulse to again reset the cycle of operation.

The resistor 328 shown in FIG. 3B is selected to be much greater than the resistor 332, to control the charging of the capacitor 326 to a given voltage and store the energy and this provides the desired energy for the light emitting diode 336. If the pulse width duration at input terminal 315 is not wide enough, the capacitor 326 will not store enough energy for the light emitting diode 336 to provide the required photon energy to develop the desired output pulse at conductor 338. The amount of photo current generated by the light emitting diode 336 depends upon how much charge is placed upon the capacitor 326, so the charging time constant determined by the resistor 328 and capacitor 326 is larger than the discharge time constant determined by the capacitor 326 and the resistor 332.

Figure 5:
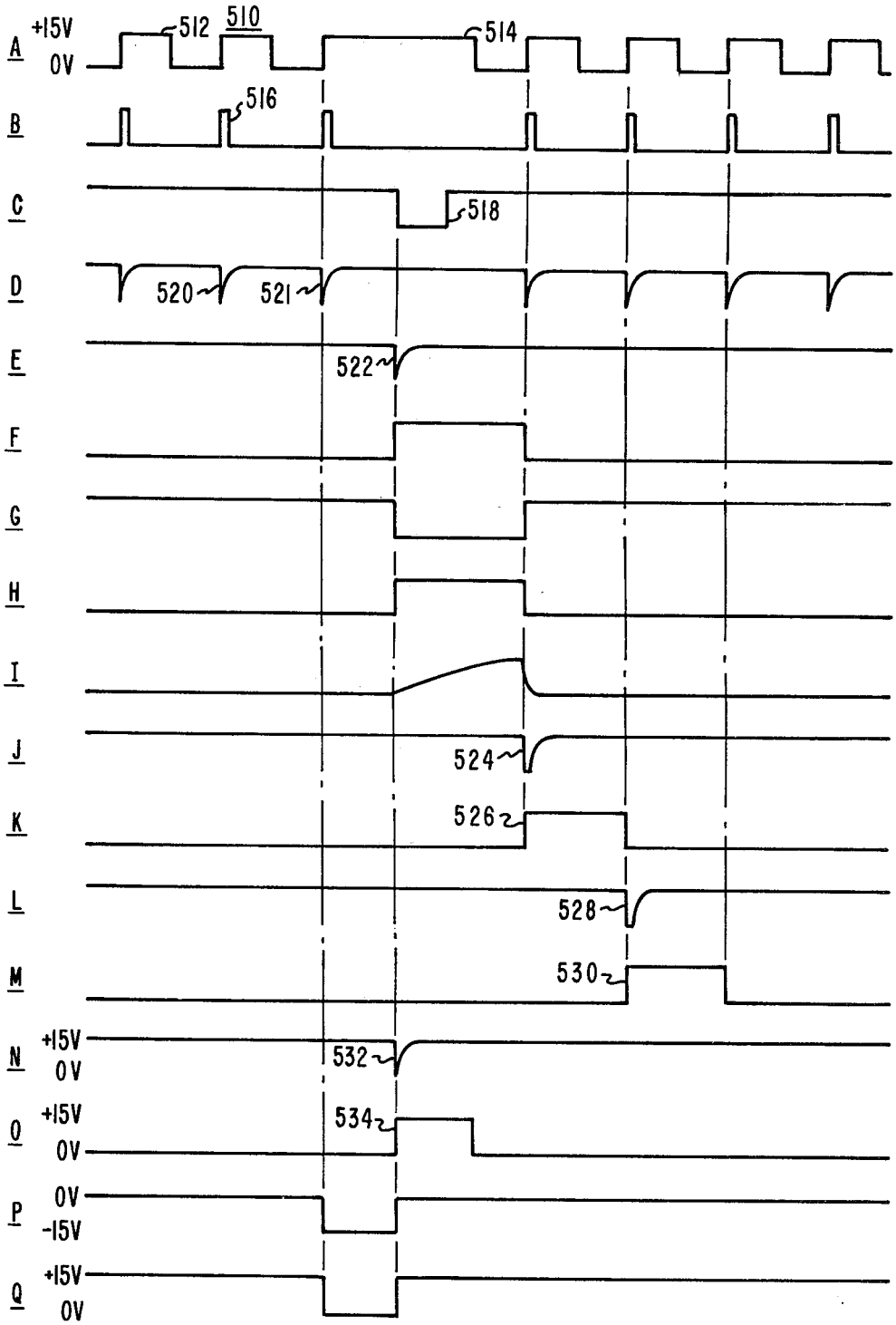
FIG. 5 shows the relationship of the various signals of interest in regard to the operation of the present invention.

In FIG. 5 there is shown the timing track waveform (A) including a desired plurality, such as thirty-one, of timing pulses 512 corresponding with the respective track circuits associated with the station 114 shown in FIG. 1 and a word pulse 514 comprising the absence of a timing pulse. At output terminal 220 in FIG. 2 there are provided the time control pulses 516 shown in waveform (B), and which are applied to input terminal 310 shown in FIG. 3A. The word control pulse 518 shown in waveform (C) appears at output terminal 222 shown in FIG. 2, and is applied to input terminal 312 shown in FIG. 3A. The shift control pulses 520 shown in waveform (D) appear on conductor 314 and at one input of NAND 316 shown in FIG. 3B, and operate to turn on the transistor 318 if it had been previously turned off by a word control pulse 518. Upon the occurrence of the word control pulse 518, a pulse 522 shown in waveform (E) appears at conductor 320 shown in FIG. 3B and operates to turn off the transistor 318 for the beginning of a new sequence cycle of operation of the time slot scanner apparatus. The pulse 522 changes the output of NAND 322 as shown by waveform (F) to turn off the transistor 318, and the next shift control pulse 520 causes the NAND 316 to change its output as shown by waveform (G) to turn on the transistor 318. The time slot pulse voltage 523 on conductor 324 at the output of the transistor 318 is shown by waveform (H). The capacitor 326 charges up to about 7.5 volts through the resistor 328 and the resistor 330 and then discharges through resistor 332, diode 334 and light emitting diode 336, as shown by waveform (I). The output terminal 338 provides the output voltage 524 shown in waveform (J) to the next successive pulse former apparatus 340.

The pulse former apparatus 340 includes a transistor switch, similar to transistor 318 of the pulse former apparatus 342, that is turned off by the output pulse 524 and thereby determines the beginning of time slot pulse two, which is shown by the voltage pulse 526 in waveform (K). The pulse former apparatus 340 provides an output pulse 528, shown in waveform (L) to the next successive pulse former apparatus 344, which in sequence determines the beginning of time slot three, as shown by the voltage pulse 530 in waveform (M). Each successive pulse former apparatus is in turn enabled by the output pulse from the next previous pulse former apparatus to begin a time slot voltage pulse and the next shift control pulse 520 then terminates this time slot voltage pulse.

The word control pulse 518 shown in waveform (C) is also applied to the reset circuit 346 at input terminal 348 of FIG. 3C, and the voltage signal 532 of waveform (N) appears at conductor 350. The voltage signal 532 turns off the transistor 352 and the transistor 354. The output pulse 521 of the last pulse former apparatus 356 shown in FIG. 3A, or if a second printed circuit similar to that shown in FIG. 3A is included within the successive sequence of pulse former devices then the output pulse of the last pulse former apparatus of that second printed circuit, is operative to turn on the transistor 354 and the following word control pulse signal 532 to turn off the transistor 354, as shown by waveform (P). The voltage pulse 534 shown in waveform (O) appears at conductor 354 to determine the turn on of the transistors 352 and 354. The voltage at output terminal 361 is in accordance with the waveform (Q) shown in FIG. 5 and is supplied to conductor 314 to enable each pulse former apparatus of the time slot scanner so the timing track pulses can then shift through the successive stages of the time slot scanner.

We claim:

1. In fail-safe pulse providing apparatus responsive to an input signal comprising a plurality of time control pulses followed by a pulse gap, the combination of:

switch means coupled with the input signal for initiating a voltage pulse in response to one of said time control pulses or said pulse gap and terminating said voltage pulse in response to the other of said one time control pulse or said pulse gap, a first impedance member, energy storage means responsive to said voltage pulse and coupled with the first impedance member and the switch means for storing a predetermined amount of energy as determined by the duration of said voltage pulse, a second impedance member, a light emitting diode coupled with the storage means and the second impedance member for providing a desired photon output in accordance with the discharge of said predetermined amount of stored energy in response to said voltage pulse, and photo-responsive switch means for providing an output pulse in accordance with said desired photon output.

2. The apparatus of claim 1, operative with said pulse gap and operative after a predetermined time period with said one time control pulse, with the storing of said energy being responsive to said pulse gap and with said output pulse being responsive to said one time control pulse.

3. The apparatus of claim 2, with said time period determining said amount of energy that is stored after the provision of the pulse gap and before the provision of said one time control pulse.

4. The apparatus of claim 1, with the energy storage means being operative with the first impedance member to provide a charging time constant to control the storing of said energy and with the energy storage means being operative with the second impedance member to provide a discharging time constant to control the provision of said desired photon output, with said charging time constant being different than the discharging time constant.

5. The apparatus of claim 4, with the charging time constant being larger than the discharging time constant.

6. The apparatus of claim 1, with said voltage pulse having a time duration greater than the time duration of said output pulse.

* * * * *